US005240764A

United States Patent [19]

Haid et al.

[11] Patent Number: 5,240,764

[45] Date of Patent: Aug. 31, 1993

[54] PROCESS FOR MAKING SPUNLACED NONWOVEN FABRICS

[75] Inventors: Joseph W. Haid, Nashville; James R. Vincent, Old Hickory, both of Tenn.

[73] Assignee: E. I. Du Pont de Nemours and Company, Wilmington, Del.

[21] Appl. No.: 882,532

[22] Filed: May 13, 1992

[51] Int. Cl.[5] ..... D03D 3/00

[52] U.S. Cl. ..... 428/224; 28/104; 28/105; 428/284; 428/288; 428/296; 428/297; 428/299

[58] Field of Search ..... 428/296, 297, 299, 288, 428/224, 284, 373; 28/104, 105; 19/145.5, 149, 296

[56] References Cited

U.S. PATENT DOCUMENTS

| | | | |
|---|---|---|---|
| 2,451,915 | 10/1948 | Buresh | 19/89 |
| 2,700,188 | 1/1955 | Buresh et al. | 19/66 |
| 2,703,441 | 3/1955 | Langdon et al. | 19/156 |
| 2,890,497 | 6/1959 | Langdon et al. | 19/156 |
| 3,485,706 | 12/1969 | Evans | 161/72 |
| 3,485,709 | 12/1969 | Evans et al. | 161/109 |
| 3,493,462 | 2/1970 | Bunting, Jr. et al. | 161/169 |
| 3,797,074 | 3/1974 | Zafiroglu | 19/156.3 |
| 4,582,666 | 4/1986 | Kentworthy et al. | 264/557 |
| 4,891,262 | 1/1990 | Nakamae et al. | 428/224 |
| 4,902,564 | 2/1990 | Israel et al. | 428/284 |

FOREIGN PATENT DOCUMENTS

| | | |
|---|---|---|
| 841938 | 5/1970 | Canada . |
| 0304825 | 3/1989 | European Pat. Off. . |
| 0321237 | 6/1989 | European Pat. Off. . |
| 1145200 | 1/1991 | Japan . |
| 9004066 | 4/1990 | PCT Int'l Appl. . |
| 1326915 | 8/1973 | United Kingdom . |

OTHER PUBLICATIONS

White, C.F., "Hydroentanglement Technology Applied to Wet-formed and Other Precursor Webs", Nonwovens, Tappi Journal pp. 187-192 (Jun. 1990).

Research Disclosure Journal No. 13755 (Sep. 1975).

*Primary Examiner*—James J. Bell

[57] ABSTRACT

A process for making spunlaced nonwoven fabrics comprised of fusible fibers and non-fusible staple length fibers. The preferred process comprises wet-laying a mixture of fusible and non-fusible staple length fibers into a nonwoven web and then lightly bonding the web to melt the fusible fibers. Optionally, the bonded web is then wound on a roll so the web can be easily transported. Thereafter, the lightly bonded web is hydraulically needled to entangle the fibers in a three-dimensional state. The hydraulically needled web is then optionally dried to remelt the fusible fibers and improve durability and abrasion resistance. The resulting spunlaced nonwoven fabrics made by the inventive process are useful in apparel and wiper applications.

13 Claims, No Drawings

PROCESS FOR MAKING SPUNLACED NONWOVEN FABRICS

FIELD OF THE INVENTION

The present invention relates to a process for making hydraulically needled, nonwoven fabrics. In particular, the present invention relates to a process for hydraulically needling wet-laid or dry-laid nonwoven webs made up of both fusible and non-fusible fibers.

BACKGROUND OF THE INVENTION

In the past, hydraulically needled (i.e., spunlaced) nonwoven fabrics have typically been made from a dry-laid precursor web, either carded or air-formed. These webs are most often hydraulically needled in unbonded form. In particular, spunlaced fabrics are generally made by continuously air-laying a batt of fibrous material and then immediately hydraulically needling the batt using high pressure water jets. A schematic view of such a continuous air-lay process is shown in FIG. 40 of U.S. Pat. No. 3,485,706 (Evans). In addition, such processes are described in White, C. F., "Hydroentanglement Technology Applied to Wet-formed and Other Precursor Webs", *Nonwovens*, Tappi Journal, pp. 187–192 (June 1990).

More recently, it has also become desirable to hydraulically needle webs that have been formed from wet-laid precursor webs. For example, U.S. Pat. No. 4,891,262 (Nakamae et al.) discloses hydraulically needling wet-laid webs made up of 100% staple length fibers. While these webs have many advantageous properties, the webs lack the abrasion resistance, lint resistance and washability necessary for certain end-uses (e.g., medical apparel and wiper applications).

Another problem associated with conventional wet-laid webs, as well as dry-laid webs, is that they do not have enough integrity to hold together during reeling or shipping operations. As noted by C. F. White, one of the specific problems associated with wet-formed precursor webs is being able to form them, reel them, and transport them to other locations. In continuous air-lay systems this is usually not a problem because the batts are hydraulically needled immediately after they are formed. Thus, as depicted in the Evans patent, web formation and hydraulic needling take place in a continuous series of steps.

It has become increasingly desirable to eliminate the large amount of equipment necessary to form such webs from the front portion of a hydraulic needling operation. Less equipment would be necessary and space would be saved if the wet-laid or dry-laid web could be transported to the hydraulic needling station in the form of pre-made roll goods. Thus, in some operations it is desirable to make web formation and hydraulic needling discontinuous steps which preferably take place at different locations.

Therefore, what is needed is a process that enables spunlaced nonwoven fabrics to be made with all the key properties of a 100% staple fiber nonwoven web, but wherein web formation and hydraulic needling take place in a discontinuous series of operation steps. The process should enhance the strength and integrity of the formed web so that the web can be transported undamaged to a different location for subsequent hydraulic needling treatment. Preferably, the process should improve the durability and abrasion resistance of the resulting spunlaced fabric. Other objects and advantages of the present invention will become apparent to those skilled in the art upon reference to the detailed description of the invention which hereinafter follows.

SUMMARY OF THE INVENTION

According to the invention there is provided a process for making spunlaced nonwoven fabrics. The process comprises, as a first step, blending a mixture of fusible fibers and non-fusible staple length fibers and forming them into a nonwoven web. The web can be formed by any conventional web forming technique (e.g., wet-lay or air-lay). The fusible fibers are present in an amount of from about 5 to 50 wt. %, preferably from about 10–30 wt. %, and the non-fusible fibers are present in an amount of from about 50–95 wt. %, preferably from about 70 to 90 wt. %. Thereafter, the nonwoven web is lightly bonded by heating the web at a temperature sufficient to melt the fusible fibers, but insufficient to melt or degrade the non-fusible fibers. Lightly bonding the nonwoven web strengthens the web and provides sufficient integrity for the web to be transported to a different location. Preferably, the web is wound on a roll after bonding so that it can be easily transported to such different location. Thereafter, the lightly bonded web is hydraulically needled so that the fibers are entangled in a three-dimensional state. Optionally, the hydraulically needled web is dried at a temperature sufficient to remelt the fusible fibers. Remelting the fusible fibers (i.e., heat setting) after hydraulic needling stabilizes the web surface and increases web durability and abrasion resistance.

The invention is also directed to spunlaced nonwoven fabrics made by the inventive process. Such spunlaced nonwoven fabrics have usefulness in apparel (e.g., medical) and wiper applications.

DETAILED DESCRIPTION OF THE PREFERRED EMBODIMENTS

The invention is directed to a process for making spunlaced nonwoven fabrics wherein a web is formed from both fusible and non-fusible fibers. The purpose of using fusible fibers is to give strength and integrity to the dry-laid or wet-laid nonwoven web after it is lightly bonded and before it is hydraulically needled. The use of fusible fibers allows the web to be transported without being damaged or destroyed. However, when bonding the nonwoven web care must be taken not to overly bond the web such that the resulting hydraulically needled fabric losses its softness and drapability.

As used herein, the term "fusible fibers" means that the fibers are thermally bondable (i.e., meltable) at a temperature below that of the degradation or melting point of the non-fusible fibers. Fusible fibers are sometimes also referred to as binder fibers. The fusible fibers can be homogeneous or they can comprise sheath-core fibers wherein the core is made up of non-fusible material and the sheath is made up of fusible material. If the fusible fibers are homogeneous, their melting temperature must be below the degradation or melting temperature of the non-fusible fibers. If the fusible fibers are of the sheath-core type, the melting temperature of the sheath must be lower than the degradation or melting temperatures of the core material and the non-fusible fibers. Preferably, the fusible fibers are comprised of 100 wt. % staple length fibers, although it should be understood that up to 100 wt. % non-staple length fusible fibers (e.g. pulp) may also be used in accordance with the invention. In other words, the fusible fibers may be all staple length fibers, all non-staple length fibers, or a mixture of both staple length fibers and non-staple length fibers. The fusible fibers are preferably selected from polyamides, polyesters, polyolefins and co-polymers thereof.

As used herein, the term "non-fusible fibers" means that the fibers are not thermally bondable (i.e., degradable or meltable) at the temperature at which the fusible fibers melt. The non-fusible fibers thus have a higher degradation or melting point than the fusible fibers. As noted above, in sheath-core fibers, a non-fusible material must make up the core material. The non-fusible fibers should be of staple length and are preferably selected from polyamides (such as aramids), polyesters, polyolefins, and cellulosic pulps and fibers.

As used herein, the term "staple length fibers" means natural fibers or cut lengths from filaments. Typically, staple fibers have a length of between about 0.25 and 6.0 inches (0.6 and 15.2 cm).

As used herein, the term "lightly bonded" means that the nonwoven web has been thermally bonded sufficiently to melt the fusible fibers and provide web integrity for easy handling and transporting, but not enough to heavily bond the web such that the web losses its softness and flexibility. Typically, the temperature necessary for lightly bonding the web is between 0° to 30° C. higher the melting point of the fusible fibers.

Initially, a fiber blend is prepared from both fusible fibers and non-fusible staple length fibers. The most important factor in determining the concentration of fusible fibers to be used in the nonwoven web and the subsequent level of heat activation (i.e., light bonding) is to determine the minimum level of strength required of the web so that it can be formed, mechanically wound on a roll, and transported before hydraulic needling. There is a minimum fusible fiber concentration such that when the fusible fibers are fully activated (i.e., lightly bonded), the web just fulfills the minimum strength requirement. The minimum fusible fiber concentration is also the preferred concentration if the fusible fibers will not be remelted (optional step) after the hydraulic needling step. Optionally, if one desires to remelt the fusible fibers after hydraulic needling, increased abrasion resistance is obtained using the minimum fusible fiber concentration. If more than the minimum concentration of fusible fibers is used, the abrasion resistance of the nonwoven web can be further increased. In this way, the abrasion resistance of the nonwoven web can be tailored depending on the concentration of fusible fibers. For purposes of the invention, the applicants have found that the minimum fusible fiber concentration is about 5 wt. %.

Once the fiber blend is prepared, webs can be formed by conventional dry-lay techniques (e.g., air-laid or carded) or they can be formed by conventional wet-lay techniques utilized in the paper or nonwoven industries. Air-laid webs can be made according to U.S. Pat. No. 3,797,074 (Zafiroglu) or by using a Rando Webber manufactured by the Rando Machine Corporation and disclosed in U.S. Pat. Nos. 2,451,915; 2,700,188; 2,703,441; and 2,890,497, the entire contents of which are incorporated herein by reference. Wet-laid webs can be generally made according to U.S. Pat. No. 4,902,564 (Israel et al.), the entire contents of which are incorporated herein by reference. The formed webs should have a basis weight of between 5 and 500 g/m$^2$ (0.15 to 15 oz/yd$^2$) before hydraulic needling.

For wet-laid webs, during the bonding step the web should be completely dried and must reach a temperature 0°-30° C., preferably 5°-25° C., above the melting point of the fusible fibers, but below the degradation or melting point of the non-fusible fibers. The residence time in the dryer depends on the dryer temperature and the desired level of bonding. These variables are dependent on the types of fibers chosen to make up the web.

In carrying out the hydraulic needling step of the invention, the hydroentanglement processes disclosed in U.S. Pat. Nos. 3,485,706 (Evans) and U.S. Pat. No. 4,891,262 (Nakamae et al.), the entire contents of which are incorporated herein by reference, may be employed. The lightly bonded webs can be hydraulically needled in the same fashion as unbonded webs. As known in the art, the hydraulically needled fabric may be patterned by carrying out the hydraulic needling step on a patterned screen or foraminous support. Nonpatterned fabrics also may be produced by supporting the web on a smooth supporting surface during the hydraulic needling step as disclosed in U.S. Pat. No. 3,493,462 (Bunting, Jr. et al.), the entire contents of which are incorporated herein by reference.

During the hydraulic needling step, the web is transported on the support and passed under several water jet manifolds of the type described in Evans. These water jet manifolds typically operate at pressures between 200 and 2,000 psi. The water jets entangle the fibers present in the web into a three-dimensional state thereby producing an intimately blended fabric. After drying at a temperature below the melting point of the fusible fibers, the resulting fabric is soft and is a suitable material for apparel and wiper applications. In particular, the fabrics are useful as disposible medical gowns and low-linting wipes.

Optionally, the hydraulically needled fabric can be dried at a temperature above the melting point of the fusible fibers to remelt the fusible fibers and increase fabric durability and abrasion resistance. Although higher durability is obtained, there is a slight decrease in the softness and drapability of the resulting fabric. This step is also referred to as heat setting the fabric.

The dried and hydraulically needled fabric may also be post texturized by many of the existing and commercially available technologies (e.g., hot or cold embossing, microcreping) to impart added softness, pliability, bulky appearance, clothlike feel and texture. By proper selection of the entangling screen, the fabric may be given a linen like pattern and texture. In addition, colored fabrics may be made up from dyed woodpulp, or dyed or pigmented textile staple fibers or both.

EXAMPLES

The following examples are provided for purposes of illustration only, and not to limit the invention in any way. In the examples, the following test methods were used to measure various physical parameters:

Taber Abrasion (abrasion resistance) was measured according to ASTM Test Method D 3884, Standard Test Method for Abrasion Resistance of Textile Fabrics (Rotary Platform, Double-Head Method). A Model 503 Standard Abrasion Tester supplied by Teledyne Taber of North Tonawanda, N.Y. (Rotary Platform, Double Head Abrasion Tester) was used as the abrasion equipment. The Tester had Calibrase CS-0 rubber base wheels with 250 gram load per wheel. Fabric samples were rotated on the Abrasion Tester until a hole was produced in the fabric. The number of rotations (cycles)

necessary to make the hole was recorded as the Taber Abrasion value.

Grab Tensile Strength and Apparent Breaking Elongation were measured according to ASTM Test Method D 1682, Standard Test Method for Breaking Load and Elongation of Textile Fabrics. The grab test was used as described in section 16 using a constant rate of extension tensile testing machine (Instron Model 1122). The smaller jaw of each clamp measured 1"×1". The specimens were 6"×4" with the long direction parallel to the direction being measured. In the examples which follow, the number of samples tested varied from example to example and the maximum obtainable load varied from example to example. Therefore, in examples where more than one sample was tested, the average value of grab tensile strength (breaking load) and apparent breaking elongation for the number of samples was reported.

EXAMPLE 1

In this example, a furnish was made by mixing 90 wt. % non-fusible rayon fibers (1.5 dpf, 10 mm rayon fibers commercially available from Courtalds of Axis, Ala.) with 10 wt. % fusible bicomponent (i.e., sheath-core) polyester fibers (3 dpf, 12 mm #255 polyester fibers supplied by Hoechst Celanese of Charlotte, N.C.) in water. The furnish was intimately mixed and formed into a wet-laid web.

The wet-laid web was lightly bonded at a temperature of 160° C. to melt the fusible fibers. This temperature was about 30° C. above the melting point of the fusible bicomponent polyester fibers and about 15° C. below the temperature at which rayon fibers start to degrade. The lightly bonded web had a basis weight of 0.9 oz/yd$^2$ (30 g/m2). The lightly bonded web was then wound on a roll so that it could be shipped.

After shipment, the lightly bonded web was then unwound from the roll and two sheets of the web were layered to make a substrate. The substrate was hydraulically needled according to the general process of Evans '706 under the following conditions:

Needling Support—75 Mesh Metal Screen
Support Speed—35 ypm
Jet Strip—5 mil holes, 40 holes per inch Six passes were made under the strip using jet pressures of 200 psi, 625 psi, 1125 psi, 1325 psi, 1525 psi and 1175 psi. The sheet was then flipped over and seven passes were made using jet pressures of 625 psi, 1200 psi, 1325 psi, 1600 psi, 1600 psi, 1600 psi and 300 psi. The hydraulically needled sheet was then air-dried (i.e., the sheet was dried at a temperature below the melting point of the fusible fibers).

The resulting spunlaced fabric had the following physical properties:

Basis Weight—1.8 oz/yd$^2$ (60 g/m$^2$)
Machine Direction Grab Tensile Strength—13 lbs.
Machine Direction Apparent Breaking Elongation—37%
Cross Direction Grab Tensile Strength—11 lbs.
Cross Direction Apparent Breaking Elongation—51%
Taber Abrasion—94 cycles Taber abrasion (abrasion resistance) was determined from four (4) samples. Each sample was appropriately sized for the abrasion tester and rotated on the tester until a hole was produced in the fabric. The number of rotations (cycles) needed to make the hole was recorded and the average number of rotations for the four (4) samples is reported above.

Grab tensile strength and apparent breaking elongation were measured on just one sample for each direction and the result for the single measurement is reported above.

EXAMPLE 2

This example is identical to Example 1, except that after hydraulic needling and air drying the fabric was heat set in a 300° F. (149° C.) oven for 5 minutes. This allowed the fusible fibers to remelt after hydraulic needling.

The resulting heat set spunlaced fabric had the following physical properties:

Basis Weight—1.8 oz/yd$^2$ (60 g/m$^2$)
Machine Direction Grab Tensile Strength—12 lbs.
Machine Direction Apparent Breaking Elongation—32%
Cross Direction Grab Tensile Strength—11 lbs.
Cross Direction Apparent Breaking Elongation—49%
Taber Abrasion—240 cycles This example showed that greater durability and abrasion resistance is obtained when the spunlaced fabric is heat set following hydraulic needling.

EXAMPLE 3

In this example, 20 wt. % non-fusible polyester fibers (0.5 dpf, 10 mm polyester supplied by Teijin of Osaka, Japan) were blended with 30 wt. % fusible bicomponent polyester fibers (2.0 dpf, 12 mm 271P bicomponent polyester supplied by E. I. du Pont de Nemours and Company, Wilmington, Del.) and 50 wt. % non-fusible scalloped oval polyester fibers (1.2 dpf, 19 mm 195W scalloped oval polyester fibers supplied by E. I. du Pont de Nemours and Company of Wilmington, Del.) to make a furnish according to Example 1. The furnish was intimately blended and formed into a wet-laid web. The wet-laid web was lightly bonded at a temperature of 160° C. as in Example 1. The lightly bonded web had a basis weight of 1.0 oz/yd$^2$ (33 g/m$^2$). The lightly bonded web was then wound on a roll so that it could be shipped.

After shipment, the lightly bonded web was then unwound from the roll and two sheets of the web were layered to make a substrate. The substrate was hydraulically needled according to the general process of Evans '706 under the following conditions:

Needling Support—75 Mesh Metal Screen
Support Speed—50 ypm
Jet Strip—5 mil holes, 7 holes per inch Six (6) passes were made under the strip using jet pressures of 250 psi, 700 psi, 1400 psi, 1600 psi, 1600 psi and 1700 psi. The sheet was then flipped over and seven (7) passes were made using jet pressures of 400 psi, 1000 psi, 1500 psi, 1500 psi, 1600 psi, 1600 psi and 800 psi. The hydraulically needled sheet was then air-dried (i.e., the sheet was dried at a temperature below the melting point of the fusible fibers).

The resulting spunlaced fabric had the following physical properties:

Basis Weight—2.1 oz/yd$^2$ (71 g/m$^2$)
Machine Direction Grab Tensile Strength—39 lbs.
Machine Direction Apparent Breaking Elongation—75%
Cross Direction Grab Tensile Strength—33 lbs.
Cross Direction Apparent Breaking Elongation—81%

Grab tensile strength and apparent breaking elongation for this example were measured on six samples for each direction and the average value of the six measurements is reported above.

EXAMPLE 4

In this example, 75% wt. % non-fusible polyester fibers (1.35 dpf, 22 mm 612W polyester supplied by E. I. du Pont de Nemours and Company, Wilmington, Del.) were blended with 25 wt. % fusible bicomponent polyester fibers (2.5 dpf, 22 mm 269 bicomponent polyester supplied by E. I. du Pont de Nemours and Company, Wilmington, Del.). The blended fiber was processed through a Rando Webber (Model 40B supplied by Curlator Corporation, East Rochester, N.Y.) in order to make a 1.2 oz/yd$^2$ air-laid web.

The air-laid web was lightly bonded in an air impingement dryer with an air temperature of 150° C. to melt the fusible fibers. This temperature was about 20° C. above the melting point of the fusible bicomponent fibers and about 100° C. below the melting point of the non-fusible polyester fibers. The lightly bonded web had a basis weight of 1.4 oz/yd$^2$.

The lightly bonded air-laid web was then hydraulically needled according to the general process of Evan's '706 under the following conditions:

Needling Support—75 Mesh Metal Screen
Support Speed—40 ypm
Jet Strip—5 mil holes, 40 holes per inch One pass was made under the jet strip with a jet pressure of 500 psi followed by five passes under the jet strip with a jet pressure of 1500 psi. The sheet was then flipped over and one pass was made under the jet strip with a jet pressure of 500 psi followed by 5 passes under the jet strip with a jet pressure of 1500 psi. The hydraulically needled sheet was then air-dried (i.e., the sheet was dried at a temperature below the melting point of the fusible fibers).

The resulting spunlaced fabric had the following physical properties:

Basis Weight—1.4 oz/yd$^2$ (47 g/m$^2$)
Machine Direction Grab Tensile Strength—17.8 lbs
Machine Direction Apparent Breaking Elongation—80%
Cross Direction Grab Tensile Strength—17 lbs
Cross Direction Apparent Breaking Elongation—78%

Grab tensile strength and apparent elongation were measured on just one sample for each direction and the result of the single measurement is reported above.

EXAMPLE 5

In this example, 75% wt. % non-fusible polyester fibers (1.35 dpf, 22 mm 612W polyester supplied by E. I. du Pont de Nemours and Company, Wilmington, Del.) were blended with 25 wt. % fusible bicomponent polyester fibers (2.5 dpf, 22 mm 269 bicomponent polyester supplied by E. I. du Pont de Nemours and Company, Wilmington, Del.). The blended fibers were processed through a Rando Webber (Model 40B supplied by Curlator Corporation, East Rochester, N.Y.) in order to make a 1.2 oz/yd$^2$ air-laid web.

The air-laid web was lightly bonded between two heated plates of a press. The plates were heated to a temperature of 150° C. to melt the fusible fibers. This temperature was about 20° C. above the melting point of the fusible bicomponent fibers and about 100° C. below the melting point of the non-fusible polyester fibers. The load generated by the press was sufficient to insure physical contact between the plates of the press and the web, but was below the load needed to generate a pressure on the web of 0.5 psi. The lightly bonded web had a basis weight of 1.2 oz/yd$^2$.

The lightly bonded air-laid web was then hydraulically needled according to the general process of Evan's '706 under the following conditions:

Needling Support—75 Mesh Metal Screen
Support Speed—40 ypm
Jet Strip—5 mil holes, 40 holes per inch One pass was made under the jet strip with a jet pressure of 500 psi followed by five passes under the jet strip with a jet pressure of 1500 psi. The sheet was then flipped over and one pass was made under the jet strip with a jet pressure of 500 psi followed by 5 passes under the jet strip with a jet pressure of 1500 psi. The hydraulically needled sheet was then air-dried (i.e., the sheet was dried at a temperature below the melting point of the fusible fibers).

The resulting spunlaced fabric had the following physical properties:

Basis Weight—1.3 oz/yd$^2$ (44 g/m$^2$)
Machine Direction Grab Tensile Strength—18 lbs
Machine Direction Apparent Breaking Elongation—82%
Cross Direction Grab Tensile Strength—18 lbs
Cross Direction Apparent Breaking Elongation—81%

Grab tensile strength and apparent elongation were measured on just one sample for each direction and the result of the single measurement is reported above.

EXAMPLE 6

In this example, a furnish was made by mixing 70 wt. % non-fusible polyester fibers (1.2 dpf, 19 mm 195W scalloped oval polyester fibers supplied by E. I. du Pont de Nemours and Company, Wilmington, Del.) and 20 wt. % non-fusible polyester fibers (0.5 dpf, 10 mm TM04N polyester fibers supplied by Teijin of Osaka, Japan) with 10% fusible "Pulplus" pulp (commercially available from E. I. du Pont de Nemours and Company, Wilmington, Del.) in water. It will be noted that this example contains fusible fibers of non-staple length. The furnish was intimately mixed and formed into a wet-laid web.

The wet-laid web was lightly bonded at a temperature of 160° C. to melt the fusible fibers. This temperature was about 40° C. above the melting point of the "Pulplus" pulp and about 100° C. below the melting point of the non-fusible polyester fibers. The lightly bonded web had a basis weight of 1.0 oz/yd$^2$ (34 g/m$^2$). The lightly bonded web was then wound on a roll so that it could be shipped.

The lightly bonded web was then unwound from the roll and two sheets of the web were layered to make a substrate. The substrate was hydraulically needled according to the general process of Evans '706 under the following conditions:

Needling Support—75 Mesh Metal Screen
Support Speed—50 ypm
Jet Strip—5 mil holes, 40 holes per inch Six passes were made under the strip using jet pressures of 250 psi, 700 psi, 1400 psi, 1600 psi, 1600 psi and 1700 psi. The sheet was then flipped over and seven passes were made using jet pressures of 400 psi, 1000 psi, 1500 psi, 1500 psi, 1600 psi, 1600 psi and 800 psi. The hydraulically needled sheet was then air-dried (i.e., the sheet was dried at a temperature below the melting point of the fusible pulp).

The resulting spunlaced fabric had the following physical properties:

Basis Weight—1.7 oz/yd$^2$ (58 g/m$^2$)
Machine Direction Grab Tensile Strength—29 lbs.
Machine Direction Apparent Breaking Elongation—87%
Cross Direction Grab Tensile Strength—25 lbs.
Cross Direction Apparent Breaking Elongation—76%

Grab tensile strength and apparent breaking elongation for this example were measured on six samples for each direction and the average value of the six measurements is reported above.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

We claim:

1. A process for making a spunlaced nonwoven fabric comprising the steps of:
   (a) blending a mixture of fusible fibers and non-fusible staple length fibers and forming a nonwoven web from the mixture of fibers, the fusible fibers present in an amount of from 5 to 50 wt. % and the non-fusible fibers present in an amount of from 50 to 95 wt. %;
   (b) lightly bonding the nonwoven web by heating the web at a temperature sufficient to melt the fusible fibers but insufficient to degrade or melt the non-fusible fibers; and
   (c) hydraulically needling the lightly bonded web so that the fibers are entangled in a three-dimensional state.

2. The process according to claim 1 wherein the nonwoven web is formed by a dry-lay process.

3. The process according to claim 1 wherein the nonwoven web is formed by a wet-lay process.

4. The process according to claim 1 wherein the fusible fibers are present in an amount of from 10 to 30 wt. % and the non-fusible fibers are present in an amount of from 70 to 90 wt. %.

5. The process according to claim 1 wherein the fusible fibers are all staple length fibers.

6. The process according to claim 1 wherein the fusible fibers are all non-staple length fibers.

7. The process according to claim 1 wherein the fusible fibers comprise both staple length fusible fibers and non-staple length fusible fibers.

8. The process according to claim 1 wherein the lightly bonded web is wound onto a roll before the web is hydraulically needled.

9. The process according to claim 1 further comprising the step of drying the hydraulically needled web at a temperature sufficient to remelt the fusible fibers.

10. The process according to claim 1 wherein the lightly bonded web is hydraulically needled using a plurality of columnar water streams at a pressure of from 200 to 2,000 psi.

11. The process according to claim 1 wherein the fusible fibers are selected from the group consisting of polyamides, polyesters, polyolefins and copolymers thereof.

12. The process according to claim 1 wherein the non-fusible fibers are selected from the group consisting of polyamides, polyesters, polyolefins and cellulosic fibers.

13. A spunlaced nonwoven fabric made by the process of any of claims 1–12.

* * * * *